US006857372B2

(12) United States Patent
Renaud-Bezot et al.

(10) Patent No.: US 6,857,372 B2
(45) Date of Patent: Feb. 22, 2005

(54) EXPLOSIVE AMMUNITION WITH FRAGMENTING STRUCTURE

(75) Inventors: Jean-Luc Renaud-Bezot, Bourges (FR); Bertrand Padiolleau, Saint Laurent sur Cher (FR)

(73) Assignee: Giat Industries (FR)

( * ) Notice: Subject to any disclaimer, the term of this patent is extended or adjusted under 35 U.S.C. 154(b) by 0 days.

(21) Appl. No.: 09/912,601

(22) Filed: Jul. 26, 2001

(65) Prior Publication Data

US 2002/0014177 A1 Feb. 7, 2002

(30) Foreign Application Priority Data

Jul. 28, 2000 (FR) ..... 00 10022

(51) Int. Cl.[7] ..... F42B 12/22
(52) U.S. Cl. ..... 102/493
(58) Field of Search ..... 102/364, 389, 102/491–497

(56) References Cited

U.S. PATENT DOCUMENTS

| | | | | | |
|---|---|---|---|---|---|
| 2,933,799 | A | * | 4/1960 | Semon | 102/493 |
| 3,000,309 | A | * | 9/1961 | Zapf | 102/493 |
| 3,156,188 | A | * | 11/1964 | Zernow | 102/491 |
| 3,491,694 | A | * | 1/1970 | Fountain | 102/493 |
| 3,566,794 | A | * | 3/1971 | Pearson et al. | 102/493 |
| 3,757,693 | A | * | 9/1973 | Shea | 102/482 |
| 3,799,054 | A | * | 3/1974 | LaRocca | 102/491 |
| 3,820,464 | A | * | 6/1974 | Dixon | 102/493 |
| 4,068,590 | A | * | 1/1978 | Pearson | 102/493 |
| 4,089,267 | A | * | 5/1978 | Mescall et al. | 102/491 |
| 4,305,333 | A | * | 12/1981 | Altenau et al. | 102/306 |
| 4,312,274 | A | * | 1/1982 | Zernow | 102/493 |
| 4,327,643 | A | * | 5/1982 | Lasheras Barrios | 102/493 |
| 4,515,083 | A | | 5/1985 | Caruso | |
| 4,664,035 | A | * | 5/1987 | Osofsky | 102/493 |
| 4,745,864 | A | * | 5/1988 | Craddock | 102/491 |
| 4,870,884 | A | * | 10/1989 | Schubart et al. | 86/20.12 |
| 5,040,464 | A | * | 8/1991 | Pearson | 102/493 |
| 5,131,329 | A | * | 7/1992 | Lips et al. | 102/364 |
| H1235 | H | * | 10/1993 | Canaday | |
| 5,337,673 | A | * | 8/1994 | Koontz et al. | 102/389 |
| 5,852,256 | A | * | 12/1998 | Hornig | 102/473 |
| 5,979,332 | A | * | 11/1999 | Hammer et al. | 102/496 |

FOREIGN PATENT DOCUMENTS

| | | | |
|---|---|---|---|
| DE | 1 176 027 | | 8/1964 |
| DE | 2518044 | A1 * | 11/1975 |
| DE | 3510431 | A1 * | 10/1986 |
| EP | 183929 | A * | 9/1985 |
| EP | 545823 | A1 * | 6/1993 |
| FR | 1.510.489 | | 1/1968 |

* cited by examiner

*Primary Examiner*—Jack Keith
*Assistant Examiner*—Troy Chambers
(74) *Attorney, Agent, or Firm*—Parkhurst & Wendel, L.L.P.

(57) ABSTRACT

The object of the invention is an explosive ammunition (1) having a fragmenting structure comprising an explosive charge (3) configured in a splinter-generating shell (2).

This ammunition is characterized by comprising a case (7) enclosing the shell (2) and containing means implementing a mechanical stress differential during ammunition ignition at the outer surface of the shell (2), where this differential enhances splinter generation and is distributed over a regular, 3D grid.

6 Claims, 4 Drawing Sheets

EXPLOSIVE AMMUNITION WITH FRAGMENTING STRUCTURE

The technical field of the present invention is that of explosive ammunition with fragmenting shells.

In general such ammunition includes an explosive charge fitted into a metal shell that shall generate splinters.

Splinters of a given size and shape may be generated by weakening the shell along a particular 3D array. Illustratively such weakening is implemented by grooving or by local laser heating.

The French patent 2,438,686 describes ammunition of which the shell is weakened in such manner.

Moreover the French patent 2,598,214 describes how to incorporate pre-shaped splinters into the shell of an ammunition.

Such designs incur the drawback of high costs.

Such costs shall be the larger the smaller the gauge of the desired ammunition (less than 70 mm): both machining and assembly will be more problematical and hence more expensive.

Accordingly it is the objective of the present invention to create ammunition palliating said drawbacks.

As a result the ammunition of the invention allows generating calibrated splinters.

Therefore the objective of the present invention is explosive ammunition with a fragmenting structure receiving an explosive charge in turn received in a splinter-generating shell and characterized in that it comprises a case enclosing the shell and being fitted with means such that, at ammunition initiation, they will cause a mechanical stress differential at the outer surface of the shell to induce splintering, said differential being regularly distributed over a 3D array.

In a first embodiment of the invention, the means causing a stress differential may include an inside case surface fitted with a salient array having recessed meshes which each are bounded by a salient rib making contact with the shell, such a configuration during ammunition initiation assuring shell weakening along said ribs in order to generate splinters.

In a second embodiment of the present invention, the means creating a stress differential may include a netting firmly affixed to the case or sandwiched between the case and the shell, said netting constituting the weakening array.

The case may be made of plastic.

The netting may be advantageously imbedded into the case.

Further embodiment particulars may include the following:

- the array may be constituted of elementary square meshes,
- the shell may be made of steel or tungsten,
- the case may constitute a ballistic nose cone for the ammunition.

The invention is elucidated in the following description of different modes of embodiment in relation to the attached drawings.

Figure 1:
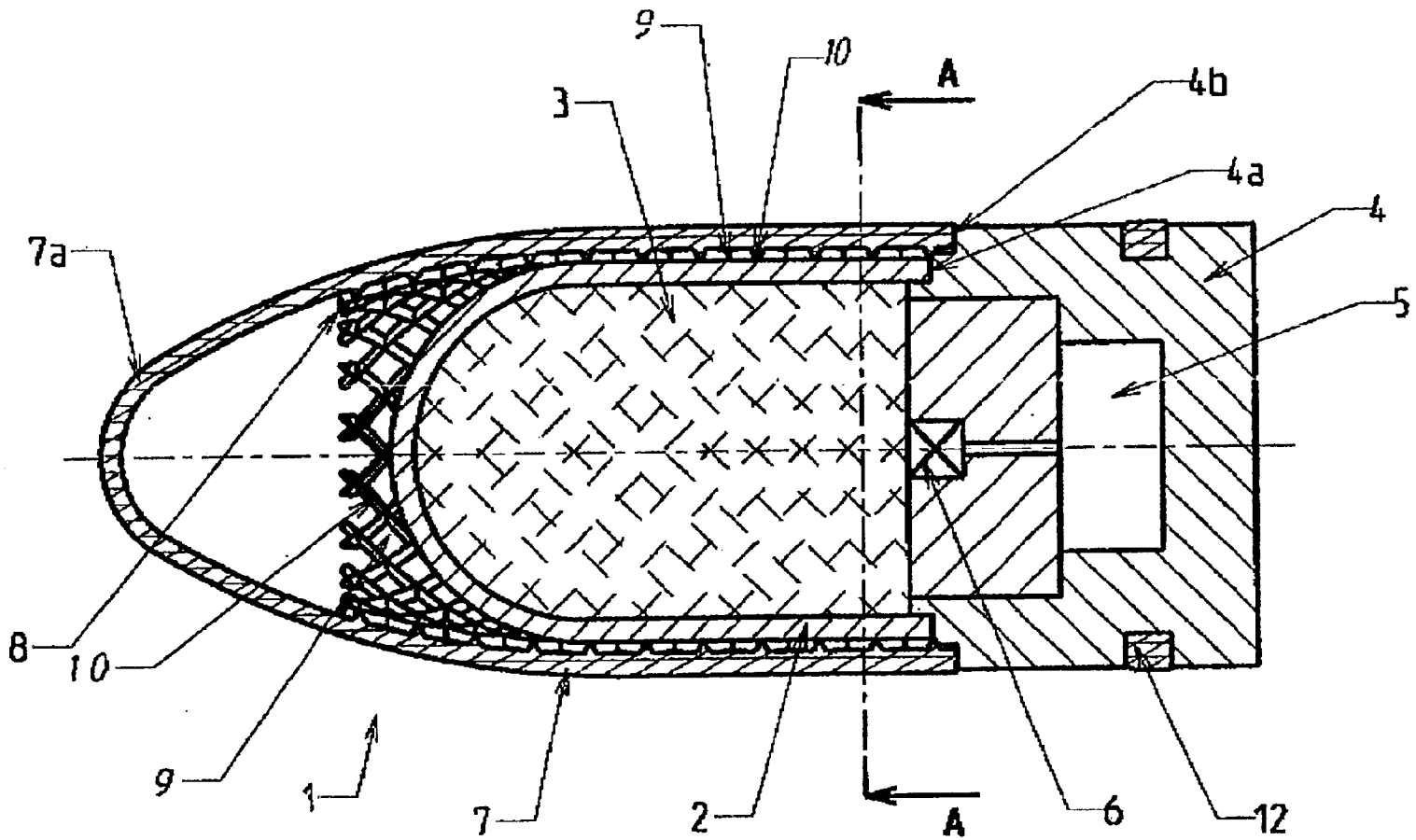
Figure 3:
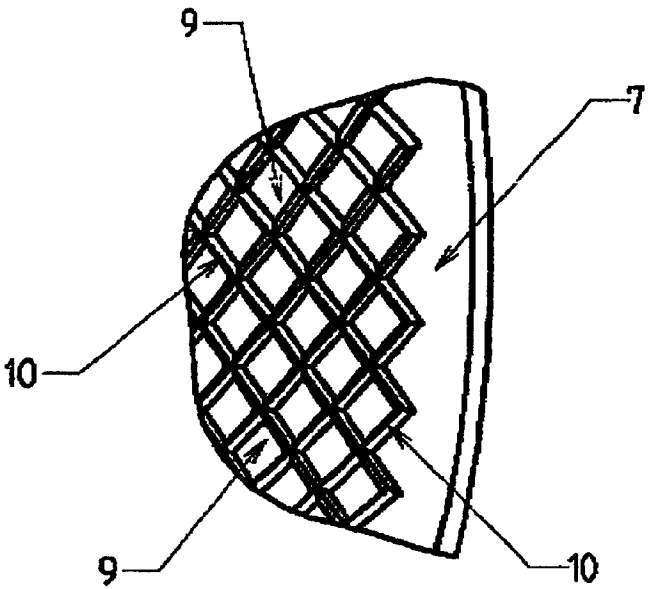
Figure 2:
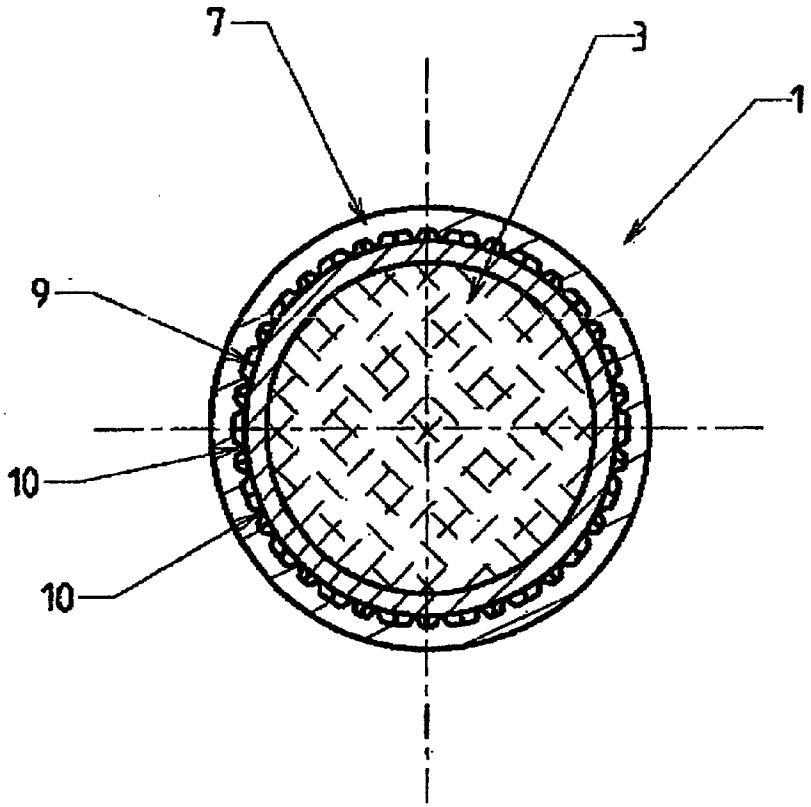
Figure 4:
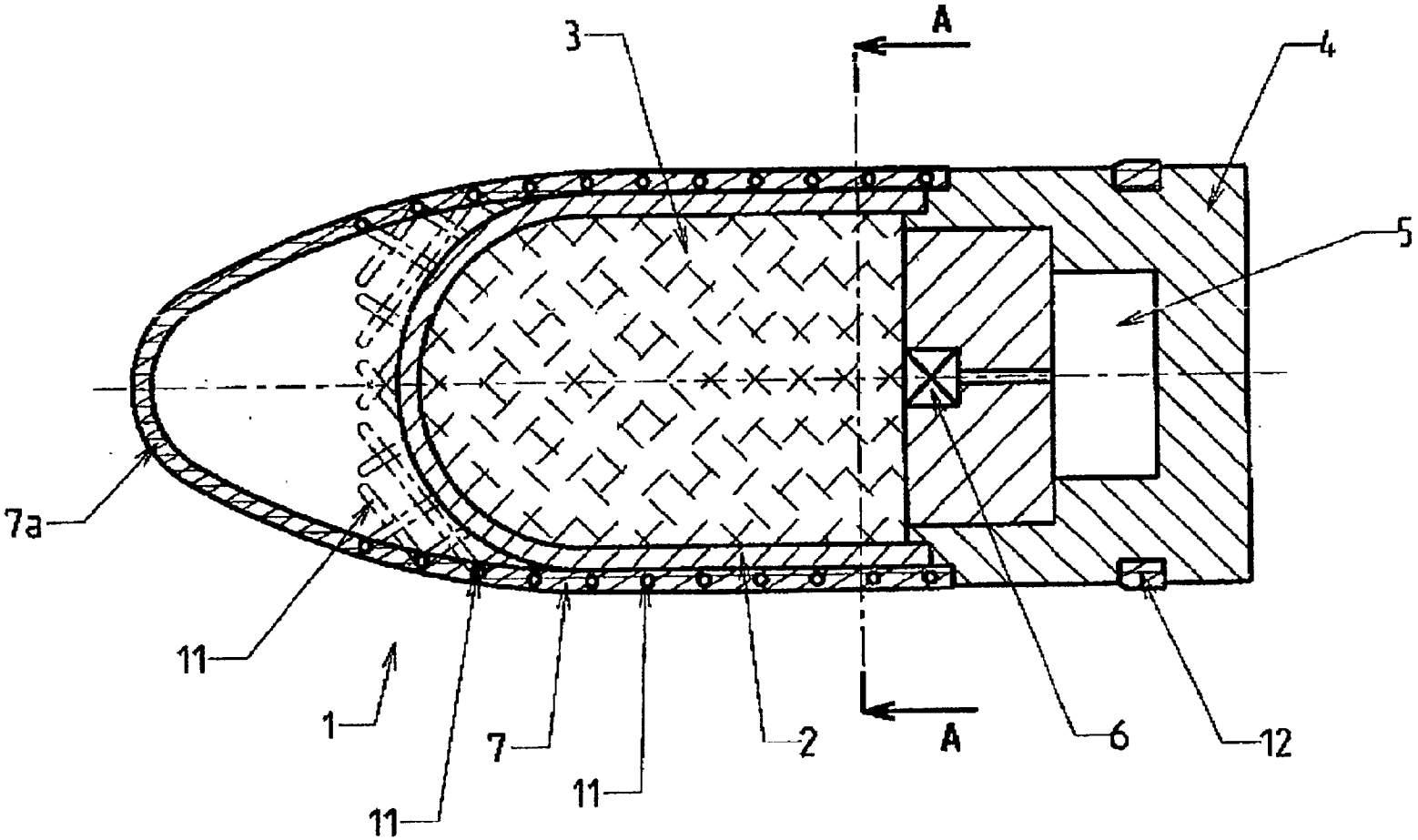
Figure 6:
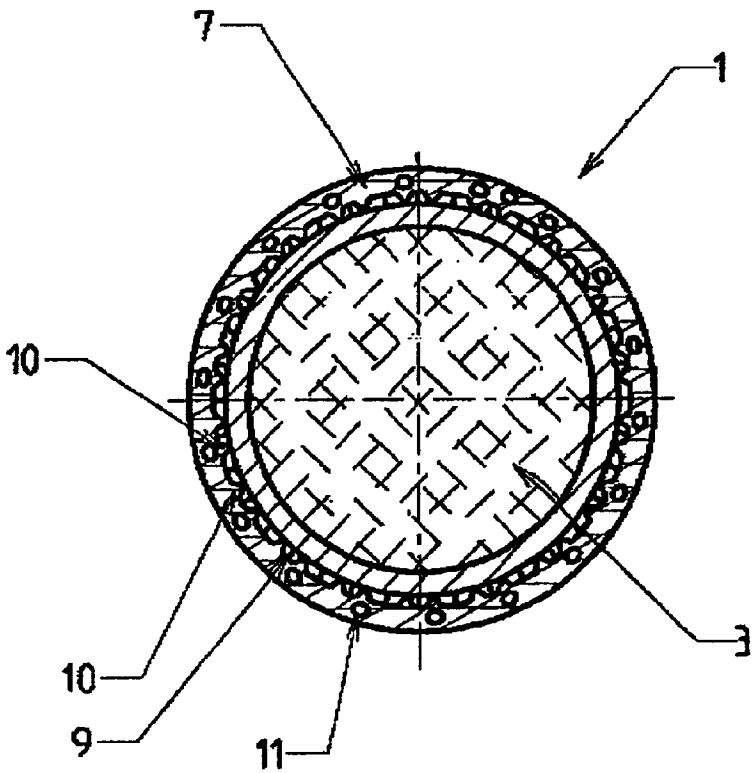
Figure 5:
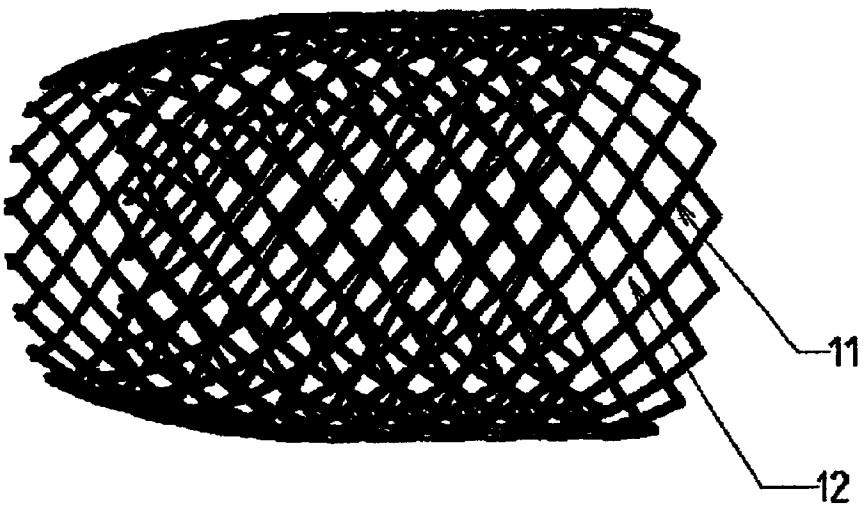

FIG. 1 is a diagrammatic longitudinal section of ammunition of a first embodiment of the invention, FIG. 2 is a cross-section of this ammunition in a plane along AA of FIG. 1, FIG. 3 is a partial perspective of a detail of the inside surface of the case of this ammunition, FIG. 4 is a schematic longitudinal section of ammunition of a second embodiment of the present invention, FIG. 5 is a perspective of the netting alone which shall be firmly joined to this ammunition's case, and FIG. 6 is a cross-section similar to that of FIG. 2 of a variation of the first embodiment.

In FIG. 1, an explosive ammunition 1 of a first embodiment of the invention comprises a fragmenting structure constituted by a shell 2 made of steel or tungsten and bounding an inside volume receiving an explosive charge 3.

The shell material shall be devoid of localized weakening meshes. Said material may have been thermally weakened for instance by quench hardening.

Illustratively by crimping, the shell 2 is fixed in place by being crimped into the zone of a shoulder 4*a* of a closing base 4 which is fitted with a belt 12 acting as a hermetic seal inside the omitted tube of a weapon.

The base 4 contains an initiation system 5 that is well known to the expert and therefore is not shown in detail and which will initiate the explosive charge 3 through a detonator 6.

The ammunition of the present invention is characterized by a case 7 enclosing the shell 2. Illustratively the case 7 is fixed in place by being glued to a second shoulder 4*b* of the base 4.

This case includes means whereby a mechanical stress differential is generated during the ammunition's explosive charge initiation at the outside surface of the shell 2. This differential is designed in such a way as to enhance the creation of splinters and it is regularly distributed over a 3D array.

Such a stress differential is attained by configuring means implementing high mechanical strength at the outside surface of the shell 2, said mechanical strength being irregular across the array which itself is regular.

Accordingly the shell fragmentation shall be oriented according to the array of said stress differential without the need to weaken beforehand said shell across a fragmentation array.

In a first embodiment shown in FIGS. 1 through 3, the means causing a stress differential comprise an inside surface 8 of the shell 7 which is fitted with an array of salients.

Each mesh 9 of this array is hollow and such a mesh is bounded by a rib 10 making contact with the shell 2.

Accordingly the case 7 makes contact with the shell 3 only by the ribs 10. Such a design assures that, during ammunition initiation, weakening of the shell 3 shall take place along the ribs 10, and that splinters calibrated to the dimensions of the array's mesh 9 shall be formed.

In this embodiment the elementary mesh of the array of meshes is square. Each side of this square is about 2 mm with respect to a 35 mm ammunition (maximum outside diameter of the case 7). The height of the mesh rib 10 is about 1 mm for a case which is 2 mm thick and is made of a plastic such as a polyamide or a polycarbonate.

The local mass of the case 7 and its bursting strength permit designing the stress differential between the (hollow) center of the meshes 9 and the ribs 10. These parameters will be controlled to appropriately selecting the material and its thickness.

Advantageously a plastic of the polyamide type is selected, though this polyamide also may be filled with glass fibers. Such a selection leads to the desired stress differential while only absorbing a small proportion of the charge's explosive energy, that is, without degrading ammunition performance.

The case 7 is fitted with a nose cone 7*a* at its front part.

Accordingly, the ammunition of the invention offers very simple manufacture and economy: The splinter-generating shell 2 comprises totally smooth inner and outer surfaces. As a result, said shell 2 can be made by sintering or forging.

After being loaded with the explosive material, the shell 2 is affixed to the base 4 fitted with the priming system 5/6.

Thereupon the case 7 is mounted around the shell 2. The inside diameter of the case 7 is selected slightly less—by a few tenths of a mm—than the outside diameter of the shell 2. In this manner very good contact is set up between the mesh ribs 10 and the outer surface of the shell 2.

The case 7 is manufactured in simple and economical manner by injecting plastic into a mold of suitable geometry. Moreover this case 7 assumes the function of a nose-cone for the ammunition.

Contrary to the case of the ammunition of the prior art, the present invention no longer requires locally weakening or locally machining the structure of the shell 2.

Therefore it is henceforth feasible to manufacture a tungsten shell in especially economic manner.

Indeed, in the prior art, such a material did require molding or sintering a shell structure fitted with the desired weakening array. Such a procedure was sensitive and very costly.

As regards the shell structure of the invention, on the other hand, it is smooth and the meshwork is determined only by the geometry of the inside surface of the case 7.

In a variation of this embodiment, the inside case surface may be fitted with a complementary topography, that is with a configuration wherein the meshes would contact the outer shell surface and would be bounded by grooves. However such a design would entail less efficacy with respect to the speed of the resulting splinters.

In terms of embodiment variations, it is feasible of course to use other geometries than those of said array of salients. Illustratively the elementary mesh may be diamond shaped, or hexagonal, or round.

FIG. 4 shows an ammunition 1 of a second embodiment of the invention.

This second embodiment differs from the first by the geometry of the means causing a stress differential at the shell.

These means comprise a netting 11 firmly affixed to the case 7. The netting makes use of a steel wire 0.1 mm in diameter. The netting may be metallic or made of a high-density (>1 g/cm$^3$) plastic, or a ceramic or a glass fiber.

The netting 11 is shown by itself in FIG. 5. Such netting is cylindrical overall. It is made by winding a planar netting and welding together the edges of its ribs.

In this instance the netting comprises an elementary mesh 12 which is square, though it may also assume other geometries (diamond, rectangular, hexagonal, circular . . . ).

The netting 11 is imbedded in the material of the case 7. Said case 7 is made of a plastic injected around the netting which is contained within the injection mold. In this manner almost the entire inner surface of the case 7 makes contact with the outer surface of the shell 2. As a result case warping during storage or transportation will be averted.

Such an embodiment mode simplifies the geometry of the mold used to fabricate the case 7. However it entails making a netting.

The advantage of such an embodiment is the manufacture of a thinner case 7. The netting assumes the function of bracing the case 7 and allows setting up the stress differential at a case thickness of roughly 1 mm.

When employing such a manufacturing mode, it is easy to pass from one mesh geometry to another merely by modifying the netting 11 without needing to modify the injection-molding equipment for the case 7.

The stress differential may be controlled by changing the wire/filament diameter of the netting 11.

As an embodiment variation, and instead of imbedding the netting into the case 7, this netting can be merely positioned between the case 7 and the shell 2.

Obviously the two embodiments described in relation to FIGS. 1 and 4 also may be combined.

Accordingly FIG. 6 shows a cross-section of ammunition 1 comprising a case 7 fitted with an inside surface comprising a raised netting of which the hollow meshes 9 are bounded by a rib 10 in contact with the shell 2. This case 7 also is fitted with an insert constituted by a netting 11 of which the meshes are substantially identical with those of the raised netting and are configured in coincidence with the meshes of this netting.

Accordingly the wires/filaments of the netting 11 are situated opposite the ribs 10 of the netting of the case 7.

Such a design allows reinforcing the geometry of the case 7 and also to increase the stress differential.

It may be possible to combine a netting with a netting with an array of salients and/or mesh geometries. Such a design would allow generating at least two kinds of splinters of different dimensions.

What is claimed is:

1. An explosive ammunition having a fragmenting structure comprising:

an inner shell having inside and outside surfaces both without a surface pattern for generating splinters, said inner shell being for splinter generation;

an explosive charge substantially surrounded by the inner shell;

an outer plastic case enclosing the inner shell; and netting located between the outside surface of said inner shell and the outer case, for generating a mechanical stress differential at the outside surface of the inner shell during initiation of the explosive charge.

2. The explosive ammunition according to claim 1, wherein said netting constitutes a weakening array.

3. The explosive ammunition according to claim 2, wherein the netting is imbedded in the case.

4. The explosive ammunition according to claim 2, wherein the array is fitted with square elementary meshes.

5. The explosive ammunition according to claim 1, wherein the shell is made of steel or tungsten.

6. The explosive ammunition according to claim 1, wherein the case constitutes a nose cone.

* * * * *